US005493374A

United States Patent [19]

Smith et al.

[11] Patent Number: 5,493,374

[45] Date of Patent: Feb. 20, 1996

[54] APPARATUS FOR CONTROLLING SHEET VELOCITY

[75] Inventors: Charles E. Smith, Pittsford; Douglas E. Webb, Fairport, both of N.Y.

[73] Assignee: Xerox Corporation, Stamford, Conn.

[21] Appl. No.: 206,684

[22] Filed: Mar. 7, 1994

[51] Int. Cl.[6] ..... G03G 21/00; G03G 15/20

[52] U.S. Cl. ..... 355/282; 355/308

[58] Field of Search ..... 355/282, 285, 355/308

[56] References Cited

U.S. PATENT DOCUMENTS

| | | | |
|---|---|---|---|
| 4,017,065 | 4/1977 | Poehlein | 271/80 |
| 4,595,279 | 6/1986 | Kuru et al. | 355/282 |
| 4,928,141 | 5/1990 | Poehlein et al. | 355/282 X |
| 4,941,021 | 7/1990 | Uchida et al. | 355/285 |
| 5,016,058 | 5/1991 | Mair | 355/282 X |
| 5,049,906 | 9/1991 | Kobayashi et al. | 355/285 X |
| 5,166,735 | 11/1992 | Malachowski | 355/282 |
| 5,333,038 | 7/1994 | Mizoguchi et al. | 355/282 X |

*Primary Examiner*—Fred L. Braun

*Attorney, Agent, or Firm*—H. Fleischer; J. E. Beck; R. Zibelli

[57] ABSTRACT

An apparatus in which an advancing copy sheet is disclosed. The apparatus includes a moving imaging member having a toner image thereon. The copy sheet contacts an imaging member to transfer a toner image from the imaging member to the copy sheet. A fusing member fuses the toner image to the copy sheet and advances the copy sheet at an adjustable velocity while the copy sheet receives the toner image from the imaging member. A controller communicates with the imaging member and the fusing member to maintain the velocity of the copy sheet with that of the imaging member. The velocity is maintained at a selected relationship. An imaging member drive moves the imaging member at a first velocity. The imaging member drive includes: a crystal clock that generates a fixed reference signal, a programmable divider which receives the signal and generates a control signal, and a servo motor responsive to the control signal. A fuser drive rotates the fuser roll to advance the sheet at a second velocity. The fuser drive includes: a voltage controlled oscillator that generates a signal responsive to the velocity differential between the imaging member drive and the fuser drive, a programmable divider which receives the signal from the voltage controlled oscillator and generates a control signal, and a servo motor responsive to the control signal. The controller includes a fixed frequency divider that receives a signal from the voltage controlled oscillator and generates a measurement signal as a function thereof.

12 Claims, 2 Drawing Sheets

APPARATUS FOR CONTROLLING SHEET VELOCITY

Figure 1:
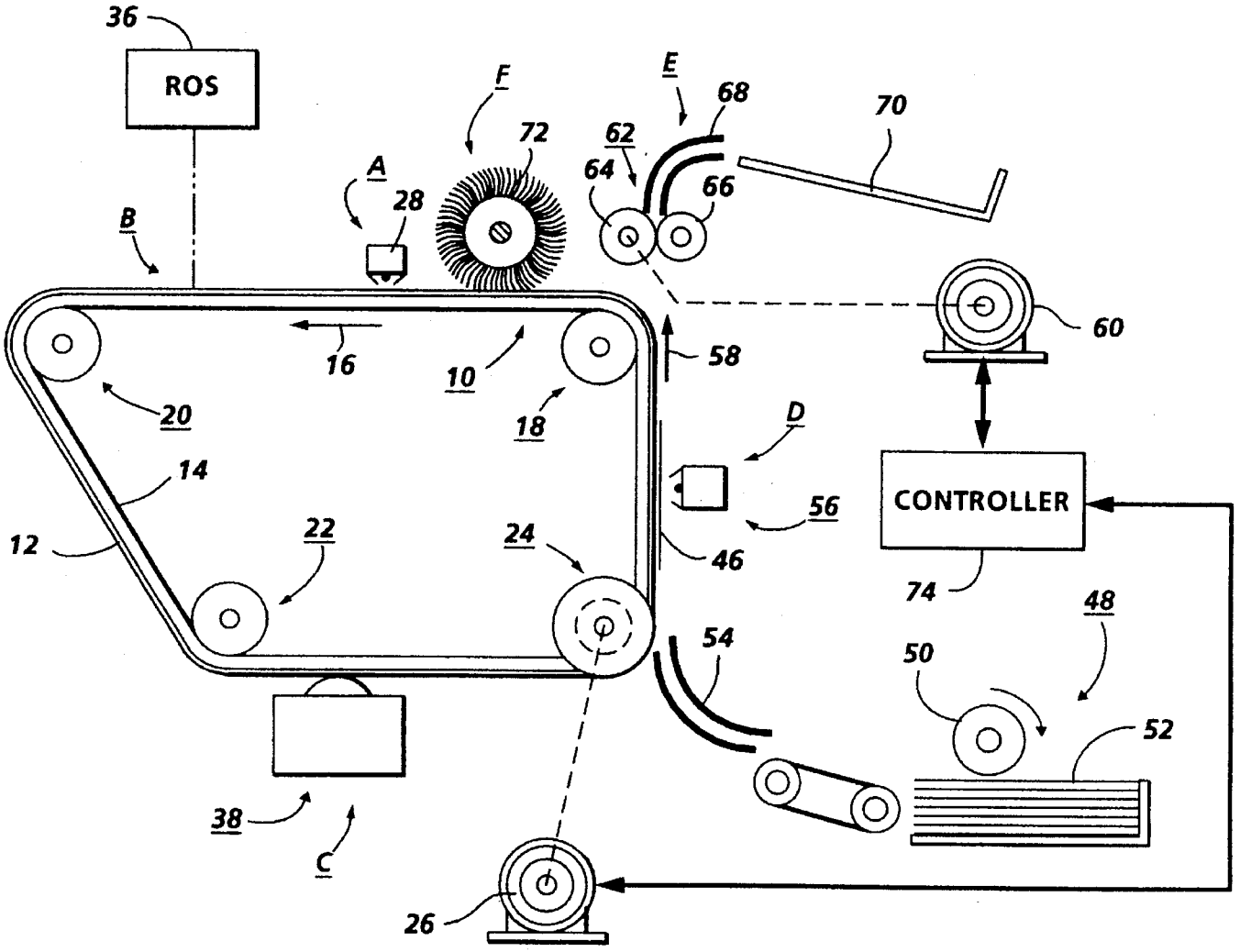

The present invention relates generally to a sheet handling system in an electrophotographic printing machine, and more particularly concerns a sheet handling system which matches the sheet velocity at the transfer station and fuser station.

In an electrophotographic printing machine, a photoconductive member is charged to a substantially uniform potential to sensitize the surface thereof. The charged portion of the photoconductive member is exposed to a light image of an original document being reproduced. Exposure of the charged photoconductive member selectively dissipates the charge thereon in the irradiated areas. This records an electrostatic latent image on the photoconductive member corresponding to the informational areas contained within the original document being reproduced. After the electrostatic latent image is recorded on the photoconductive member, the latent image is developed by bringing developer material into contact therewith. This forms a powder image on the photoconductive member.

In the foregoing type of printing machine, the powder image formed on the photoconductive member is transferred from the photoconductive member to a copy sheet. The transferred powder image is typically only loosely applied to the copy sheet whereby it is easily disturbed by the process of stripping the copy sheet from the photoconductive member and by the process of transporting the copy sheet to a fusing station. The copy sheet preferably passes through a fusing station as soon as possible after transfer to fuse the powder image permanently onto the copy sheet. Fusing prevents smearing and disturbance of the powder image caused by mechanical agitation or electrostatic fields. For this reason, and also for reasons of simplifying and shortening the paper path of an electrophotographic printing machine, it is desirable to maintain the fusing station as close as possible to the transfer station. A particularly desirable fusing station is a roll-type fuser, wherein the copy sheet is passed through a pressure nip existing between two rolls.

When such a fuser roll nip for the copy sheet is located close enough to the transfer station so that a lead portion of the copy sheet can be in the fuser roll nip simultaneously with the rear or trailing portion of the copy sheet being in contact with the photoconductive member, smears or skips in the unfused powder image, which is being transferred to the trailing portion of the copy sheet, can occur. This condition is caused by relative movement or slippage between the photoconductive member and the copy sheet in those areas where they are still in contact such as, for example, those areas of the copy sheet which has not yet been stripped away from the photoconductive member. A source of such slippage is a speed mismatch between the nip speed of the fuser rolls (the speed at which the fuser is pulling the lead edge of the copy sheet through the fuser) relative to the surface speed of the photoconductive member. If the fuser nip roll is slower, the copy sheet can slip backwards relative to the photoconductive member. If the fuser roll is faster, the copy sheet can be pulled forward relative to the photoconductive member. In either case, this can cause the aforementioned smears or skips in the powder image to be transferred to the trailing area of the copy sheet or to cause image elongation.

An equal velocity drive connection between the copy sheet and the fuser rolls has heretofore been difficult to maintain. Changes in the actual copy sheet driving velocity of the fuser nip roll may be caused by changes in an effective diameter of the driving roll in the nip. This may occur with replacement of the rollers or changes in the resilient deformation of the rollers which correspondingly is due to changes in applied nip pressure, material aging, and temperature effects. Thus, equal speed is difficult to maintain between a fuser nip roll and the photoconductive member in commercial electrophotographic printing machines. It has led to increased maintenance and the need for speed adjustment mechanisms.

While a toner powder has hereinbefore been discussed, one skilled in the art will appreciate that a liquid developer material may also be used. In a liquid developer material system, similar problems arise due to speed mismatches.

Four basic design approaches have been previously taken in order to overcome these problems. The first allows for enough paper path distance between transfer and fusing to accommodate most paper sizes with minimum disturbance to unfused powder images. This solution has the effect of increasing the length of the paper path, thereby requiring the electrophotographic printing machine to occupy a large floor area. This is disadvantageous, especially to customers having limited space availability or having high floor space costs.

A second approach is to use complex paper paths with special transports. This solution is undesirable because it adds cost to the equipment and introduces potential sources of maintenance requirements and unreliability.

A third approach is to use buckle chambers between the transfer station and the fuser so that speed mismatches between the transfer station and the fuser rolls can be accommodated by the portion of the copy sheet that is in the buckle. Some of these systems require sensing of the buckle to maintain the size of the buckle within predetermined limits. The sensors increase the manufacturing costs of the electrophotographic printing machine, and require additional preventive maintenance to remove dust and dirt from within the equipment that normally can interfere with sensing, particularly when optical detectors are used.

A fourth approach is to use a sheet transport incorporating a control for matching drive speeds imparted to a copy sheet extending between adjacent workstations.

The following disclosures appear to contain relevant subject matter:

U.S. Pat. No. 4,017,065

Patentee: Poehlein

Issued: Apr. 12, 1977

U.S. Pat. No. 4,941,021

Patentee: Uchida et al.

Issued: Jul. 10, 1990

U.S. Pat. No. 5,166,735

Patentee: Malachowski

Issued: Nov. 24, 1992

The disclosures of the above-identified patents may be briefly summarized as follows:

U.S. Pat. No. 4,017,065 discloses a buckle arrangement. In the designs disclosed in this patent, the image surface is formed in a buckle by being drawn, by vacuum, against a guide surface. The fuser roll nip is intentionally driven at a different speed than the transfer speed to form a buckle. The buckle is controlled by cyclic reductions in the vacuum applied to the guide surface.

U.S. Pat. No. 4,941,021 discloses another buckle arrangement, wherein the buckle is formed by controlling the speed of the fuser rolls so that the copy sheet travels more slowly through the fuser rolls than through the transfer zone. This system requires sensing of the buckle to maintain the size of the buckle within predetermined limits.

U.S. Pat. No. 5,166,735 discloses a sheet transport incorporating a control for matching drive speeds to a copy sheet extending between adjacent workstations. The copy sheet is engaged by a receiving surface disposed between the workstations and is adhered to the receiving surface by a vacuum. The copy sheet follows a path offset from a linear path extending between the workstations. Fuser rolls are driven at a slightly higher speed to tension the copy sheet and lift it from the transport surface. The lifting is detected by a sensor for sensing the vacuum in a plenum communicated with the receiving surface. The drive speed of the fuser rolls is controlled in accordance with the signal from the sensor.

Pursuant to the features of the present invention, there is provided an apparatus for advancing a sheet. A moving imaging member having a toner image thereon is included with the sheet being adapted to receive the toner image from the imaging member. A fusing member is adapted to fuse the toner image to the sheet and advances the sheet at an adjustable velocity. A controller, in communication with the imaging member and the fusing member, maintains the sheet velocity at a selected relationship with that of the imaging member.

In accordance with another aspect of the present invention, there is provided an electrophotographic printing machine of the type having a toner image recorded on a moving photoconductive member adapted to be transferred to a sheet. The improvement includes a fusing member adapted to fuse the toner image to the sheet and advance the sheet at an adjustable velocity. A controller, in communication with the photoconductive member and the fusing member, maintains the sheet velocity at a selected relationship with that of the imaging member.

Figure 2:
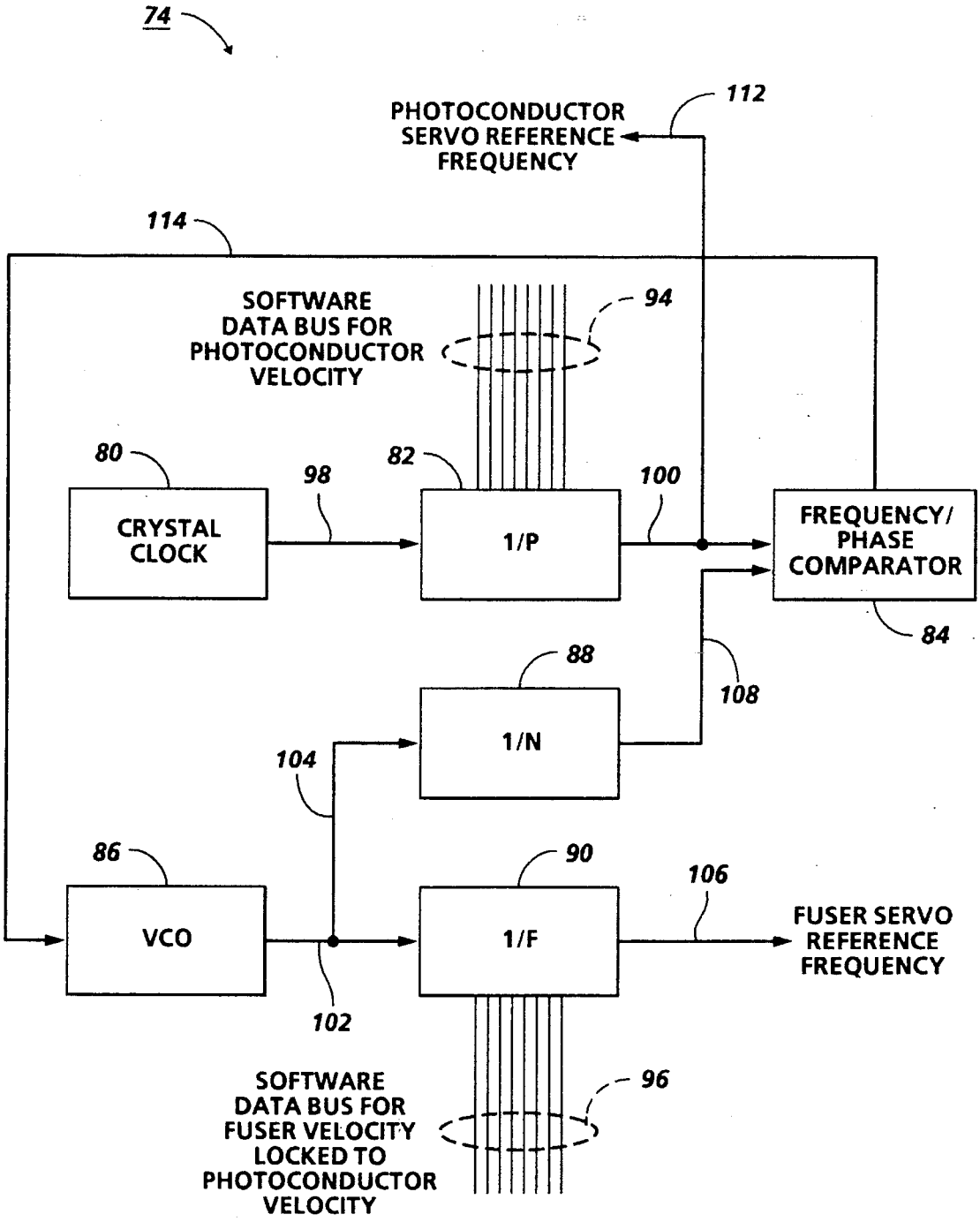

Other aspects of the present invention will become apparent as the following description proceeds and upon reference to the drawings, in which:

FIG. 1 is a schematic, elevational view showing an electrophotostatic printing machine incorporating the features of the present invention therein; and FIG. 2 is a schematic block diagram of a controller used in the FIG. 1 printing machine to match sheet velocity at the transfer station and fusing station.

While the present invention will hereinafter be described in connection with a preferred embodiment thereof, it will be understood that it is not intended to limit the invention to that embodiment. On the contrary, it is intended to cover all alternatives, modifications and equivalents that may be included within the spirit and scope of the invention as defined by the appended claims.

For a general understanding of the features of the present invention, reference is made to the drawings. In the drawings, like reference numerals have been used throughout to designate identical elements. FIG. 1 schematically depicts the various elements of an illustrative electrophotographic printing machine incorporating the control system of the present invention therein. It will become evident from the following discussion that the control system is equally well suited for use in a wide variety of printing machines and is not necessarily limited in its application to the particular embodiment depicted herein.

Inasmuch as the art of electrophotographic printing is well known, the various processing stations employed in the FIG. 1 printing machine will be shown hereinafter and their operation described briefly with reference thereto.

Turning to FIG. 1, the electrostatic printing machine employs a belt 10 having a photoconductive surface 12 deposited on a conductive substrate 14. By way of example, photoconductive surface 12 may be made from a selenium alloy with conductive substrate 14 being made from an aluminum alloy which is electrically grounded. Other suitable photoconductive surfaces and conductive substrates may also be employed. Belt 10 moves in the direction of arrow 16 to advance successive portions of photoconductive surface 12 through the various processing stations disposed about the path of movement thereof. As shown, belt 10 is entrained about rollers 18, 20, 22, 24. Roller 24 is coupled to motor 26 which drives roller 24 so as to advance belt 10 in the direction of arrow 16. Rollers 18, 20, and 22 are idler rollers which rotate freely as belt 10 moves in the direction of arrow 16.

Initially, a portion of belt 10 passes through charging station A. At charging station A, a corona generating device, indicated generally by the reference numeral 28, charges a portion of photoconductive surface 12 of belt 10 to a relatively high, substantially uniform potential.

Next, the charged portion of photoconductive surface 12 is advanced through exposure station B. At exposure station B, a Raster Input Scanner (RIS) and a Raster Output Scanner (ROS) are used instead of a light lens system. The RIS (not shown) contains document illumination lamps, optics, a mechanical scanning mechanism and photosensing elements such as charged couple device (CCD) arrays. The RIS captures the entire image from the original document and converts it to a series of raster scan lines. These raster scan lines are the output from the RIS and function as the input to a ROS 36 which performs the function of creating the output copy of the image and lays out the image in a series of horizontal lines with each line having a specific number of pixels per inch. These lines illuminate the charged portion of the photoconductive surface 12 to selectively discharge the charge thereon. An exemplary ROS 36 has lasers with rotating polygon mirror blocks, solid state modulator bars and mirrors. Still another type of exposure system would merely utilize a ROS 36 with the ROS 36 being controlled by the output from an electronic subsystem (ESS) which prepares and manages the image data flow between a computer and the ROS 36. The ESS (not shown) is the control electronics for the ROS 36 and may be a self-contained, dedicated minicomputer. Thereafter, belt 10 advances the electrostatic latent image recorded on photoconductive surface 12 to development station C.

One skilled in the art will appreciate that a light lens system may be used instead of ROS heretofore described. An original document may be positioned face down upon a transparent platen. Lamps would flash light rays onto the original document. The light rays reflected from original document are transmitted through a lens forming a light image thereof. The lens focuses the light image onto the charged portion of photoconductive surface to selectively dissipate the charge thereon. This records an electrostatic latent image on the photoconductive surface which corresponds to the informational areas contained within the original document disposed upon the transparent platen.

At development station C, a magnetic brush developer system, indicated generally by the reference numeral 38, transports developer material comprising carrier granules having toner particles adhering triboelectrically thereto into contact with the electrostatic latent image recorded on photoconductive surface 12. Toner particles are attracted from the carrier granules to the latent image forming a powder image on photoconductive surface 12 of belt 10.

After development, belt 10 advances the toner powder image to transfer station D. At transfer station D, a sheet of support material 46 is moved into contact with the toner powder image. Support material 46 is advanced to transfer station D by a sheet feeding apparatus, indicated generally by the reference numeral 48. Preferably, sheet feeding apparatus 48 includes a feed roll 50 contacting the uppermost sheet of a stack of sheets 52. Feed roll 50 rotates to advance the uppermost sheet from stack 50 into sheet chute 54. Chute 54 directs the advancing sheet of support material 46 into contact with photoconductive surface 12 of belt 10 in a timed sequence so that the toner powder image developed thereon contacts the advancing sheet of support material at transfer station D.

Transfer station D includes a corona generating device 56 which sprays ions onto the backside of sheet 46. This attracts the toner powder image from photoconductive surface 12 to sheet 46. After transfer, the sheet continues to move on belt 10 in the direction of arrow 58 to fusing station E.

Fusing station E includes a fuser assembly, indicated generally by the reference numeral 62, which permanently affixes the powder image to sheet 46. Preferably, fuser assembly 62 includes a heated fuser roller 64 driven by a motor 60 and a back-up roller 66. Sheet 46 passes between fuser roller 64 and back-up roller 66 with the toner powder image contacting fuser roller 64. In this manner, the toner powder image is permanently affixed to sheet 46. After fusing, chute 68 guides the advancing sheet to catch tray 70 for subsequent removal from the printing machine by the operator.

Invariably, after the sheet of support material is separated from photoconductive surface 12 of belt 10, some residual particles remain adhering thereto. These residual particles are removed from photoconductive surface 12 at cleaning station F. Cleaning station F includes a pre-clean corona generating device (not shown) and a rotatably mounted fibrous brush 72 in contact with photoconductive surface 12. The pre-clean corona generator neutralizes the charge attracting the particles to the photoconductive surface. These particles are cleaned from the photoconductive surface by the rotation of brush 72 in contact therewith. One skilled in the art will appreciate that other cleaning means may be used such as a blade cleaner. Subsequent to cleaning, a discharge lamp (not shown) floods photoconductive surface 12 with light to dissipate any residual charge remaining thereon prior to the charging thereof for the next successive imaging cycle.

The drive system comprising motor 26 is designed to maintain photoconductive belt 10 at a smooth and constant surface velocity. This velocity is set so that the ROS 36 paints exactly "S" scan lines per millimeter as belt 10 passes imaging station B. The ROS produces a precise frequency of "R" lines per second and the velocity "V" of belt 10 is frequency locked to the same reference frequency as "R" through a software settable divider of 1/P.

This arrangement allows the writing of precise image bar patterns on the photoconductive surface 12 of belt 10 with a spatial frequency of S/2K cycles per millimeter and a temporal frequency of V×(S/2K) cycles per second. A precise bar pattern so written on the photoconductive surface 12 of belt 10 can be developed at development station C, optically detected, and electrically analyzed to measure its temporal frequency which is a direct analog of the velocity (V) of belt 10.

The precisely developed bar on the photoconductive surface 12 of belt 10 can be transferred to support material 46. Later, observations and analysis of the bar pattern on the support material 46 can yield an accurate measure of the velocity of the support material 46 ($Vc_n$) at the point in the sheet path where it was observed.

It is both the relative velocity (V) of belt 10 and the relative velocity of the image carrying side of support material 46 ($Vc_n$) that must be carefully controlled. These relative velocities are controlled by a controller, indicated generally by reference number 74.

The fuser nip velocity can never be allowed to be greater than the velocity of belt 10; it must always be slower (unless a sufficiently large paper buckle between the two has been created before the fuser engages the support material). Depending upon the distance between the belt 10 and fusing station E, a small buckle can be allowed to grow during simultaneous engagement.

If, for example, the distance between the belt 10 and fusing station E is 125 millimeters and the system must handle 460 millimeter long lengths of support material 46, then 335 millimeters of support material are simultaneously traveling on the belt and in the fusing nip. Furthermore, if no more than a 1.50 millimeter build up of paper can be allowed during the 335 millimeter joint travel time then the following equation:

$$\{1-(1.5/335)\}<V_{FN}/V_{PR}<1.000$$

can be written to have bounded tolerances with sufficient safety:

$$\{1-(1.5/335)\}<V_{FN}/V_{PR}<\{1-1.5/(2)(335)\}, \text{ and } 0.996<V_{FN}/V_{PR}<0.998$$

where:

$V_{FN}$ is equal to the velocity of the fuser nip, and $V_{P/R}$ is equal to the velocity of the photoconductive belt.

Due to mechanical tolerances and heat influences over time, the photoconductive surface 12 of belt 10 and the fuser roller 64 cannot be driven by the same power source. As shown in FIG. 1, fuser roller 64 is separately driven by motor 60 while belt 10 is driven by motor 26. However, since the velocity of belt 10 must be very closely controlled and the relative velocity between belt 10 and the fuser roll 64 must be just as closely controlled, a pair of good digital servo drives are used, wherein their outputs are related.

Belt 10 is driven at a constant velocity, $V_{P/R}$, such that:

$$V_{P/R}=V_{IO}\{1\pm0.001\}$$

from a crystal clock reference frequency equal to $F_{IO}$ hertz from which is derived a servo reference frequency of $F_{IO}/P$ hertz which is equal to the crystal clock reference frequency divided by the value of the software settable divider. To meet the relative velocity requirements, the fuser servo reference frequency should be approximately $F_{IO}/2P$, due to the differences existing between the diameter of drive roller 24 that advances belt 10 in the direction of arrow 16, and the diameter of fuser drive roller 64. Electrical signals from the motor 26 and the motor 60 are supplied from a controller 74 that comprises a dedicated apparatus for controlling all the relative requirements explained heretofore. Thus, the controller 74 controls the fuser servo drive motor 60 and the velocity of the support material 46 driven thereby within a given percentage range of the velocity of belt 10. A large value of "F" provides finer resolution in the incremental control change to the fuser servo drive motor 60 so as to maintain the desired match in velocity. Further details of the controller 74 of the present invention will be described hereinafter with reference to FIG. 2.

Referring now to FIG. 2, controller 74 has a first and fixed frequency reference (crystal clock) 80 having a piezoelectric sensor (not shown), preferably in the form of an AT cut quartz crystal plate, employed to form a resonant vibratory device at a frequency of approximately 5.0±0.01% MHz. The crystal clock 80 is connected to the input of a first programmable frequency divider 82 by a conductor 98. Programming of the frequency divider 82 may be supplied by a software routine residing in the main controller for the printer/copier or in a dedicated microprocessor (not shown). Thus, a programmable, binary number P is presented to the parallel input of the frequency divider 82 on a data bus 94. The output of the frequency divider 82 is presented to a first input of a frequency/phase comparator 84 by a conductor 100. Correspondingly, the output of frequency divider 82 is also presented as a photoconductive belt servo reference frequency to motor 26 of FIG. 1 via a conductor 112. The output of the frequency/phase comparator 84 is fed back to the input of a voltage controlled oscillator (VCO) 86 by a conductor 114.

VCO 86 forms a second and variable frequency reference. The output of VCO 86 is connected to the input of a second programmable frequency counter 90 by a conductor 102. Programming of the frequency counter 90 may also be supplied by a software routine residing in the main controller for the printer/copier or in a dedicated microprocessor (not shown). A programmable, binary n umber F is presented to the parallel input of the frequency divider 90 on a data bus 96. The output of frequency divider 90 is presented as a fuser drive servo reference frequency to motor 60 of FIG. 1 via a conductor 106. Correspondingly, the input of frequency divider 90 is also presented as an input to a fixed divide by N frequency divider 88 by a conductor 104. The output of the fixed frequency divider 88 is presented as a second input to the frequency/phase comparator 84 via conductor 108.

The crystal clock 80 (which provides the velocity control for the ROS discussed with reference to FIG. 1) may be required to be divided by a "P" value of 1005, at frequency divider 82, to produce a spatial bar pattern of 5.00 cycles per millimeter on the photoconductive belt 10. The spatial bar pattern is observed on the moving photoconductive belt 10 as a temporal frequency equal to 1,510 Hz. This indicates photoconductive belt 10 velocity of 302.000 millimeters per second.

With the fuser servo divider 90 set to divide by 2000 by data on bus 96, the transferred bar pattern on the support material exiting the fuser produces a spatial frequency of 1494.9 Hz. to indicate that the velocity of the fuser nip is:

$$V_{FN}=0.990\ V_{P/R}$$

This is slower than desired and may produce too large a paper buckle entering the fuser. The centered relationship that is desired for the velocity of the fuser nip is:

$$V_{FN}=0.997\ V_{P/R}$$

To change the velocity of the fuser nip, the value of "F" must be reset to a new value such that:

$$F=(0.990\div 0.997)(2000)=1986.$$

If the crystal clock 80 is oscillating at a frequency equal to 4.99975 Mhz. and the value of "P" on data bus 94 is 1005, the first input of frequency/phase comparator 84 as well as the photoconductive belt servo reference frequency to motor 26 of FIG. 1 will be 4.97488 Khz. The VCO 86 will then produce a frequency of 4.974876 MHz. and the fuser drive servo reference frequency to motor 60 of FIG. 1 will be 2.504973 Khz.

Values for "P" and "F" can be checked and reset at any time by software routines residing in the main controller for the printer/copier or in a dedicated microprocessor (not shown).

In recapitulation, it is clear that the apparatus of the present invention includes a controller for measuring the velocity differential between a first and second drive to drive copy sheets at a velocity lower than the velocity at which the first drive drives the copy sheets. The controller is in communication with both the photoconductive belt driven by the first drive, and the fuser roll driven by the second drive to maintain the velocity of the copy sheet with that of the photoconductive belt. The velocity is maintained at a selected relationship.

It is, therefore, evident that there has been provided, in accordance with the present invention, a sheet transport system that fully satisfies the aims and advantages of the invention as hereinabove set forth. While the invention has been described in conjunction with a preferred embodiment thereof, it is evident that many alternatives, modifications, and variations may be apparent to those skilled in the art. Accordingly, it is intended to embrace all such alternatives, modifications, and variations as are within the broad scope and spirit of the appended claims.

We claim:

1. An apparatus for advancing a sheet, including:

an imaging member moving at a first velocity having a toner image thereon with the sheet being adapted to receive the toner image from said imaging member;

a fusing member moving at a second velocity and being adapted to fuse the toner image to the sheet and advance the sheet at an adjustable velocity as the sheet receives the toner image from said imaging member; and a controller, in communication with said imaging member and said fusing member, to maintain the second velocity of said fusing member at a selected velocity less than the first velocity of said imaging member.

2. An apparatus according to claim 1, wherein said fusing member includes:

a rotatable fuser roll; and a pressure roll in contact with said fuser roll to define a nip through which the sheet passes for fusing the toner image to the sheet, said fuser roll and pressure roll being spaced from said imaging member a distance less than a distance between the sheet leading and trailing edges in the sheet direction of movement between said imaging member and said fuser roll.

3. An apparatus according to claim 2, further including:

first drive means for moving said imaging member at a first velocity; and second drive means for rotating said fuser roll to advance the sheet at a second velocity, said controller being in communication with said first drive means and said second drive means.

4. An apparatus for advancing a sheet, including:

a moving imaging member having a toner image thereon with the sheet being adapted to receive the toner image from said imaging member;

a fusing member including a rotatable fuser roll, and a pressure roll in contact with said fuser roll to define a nip through which the sheet passes for fusing the toner image to the sheet, said fuser roll and pressure roll being spaced from said imaging member a distance less than a distance between the sheet leading and trailing edges in the sheet direction of movement between said imaging member and said fuser roll;

first drive means for moving said imaging member at a first velocity including a crystal clock which generates a fixed reference signal, a programmable divider adapted to receive the fixed reference signal and generate a control signal as a function thereof, and a servo motor responsive to the control signal;

second drive means for rotating said fuser roll to advance the sheet at a second velocity; and a controller, in communication with said imaging member and said fusing member, to maintain the velocity of said fusing member at a selected relationship with that of said imaging member.

5. An apparatus for advancing a sheet, including:

a moving imaging member having a toner image thereon with the sheet being adapted to receive the toner image from said imaging member;

a fusing member including a rotatable fuser roll, and a pressure roll in contact with said fuser roll to define a nip through which the sheet passes for fusing the toner image to the sheet, said fuser roll and pressure roll being spaced from said imaging member a distance less than a distance between the sheet leading and trailing edges in the sheet direction of movement between said imaging member and said fuser roll;

first drive means for moving said imaging member at a first velocity;

second drive means for rotating said fuser roll to advance the sheet at a second velocity including a voltage controlled oscillator which generates a signal responsive to the velocity differential between said first drive means and said second drive means, a programmable divider adapted to receive the signal from said voltage controlled oscillator and generate a control signal based as a function thereof, and a servo motor responsive to the control signal; and a controller, in communication with said imaging member and said fusing member, to maintain the velocity of said fusing member at a selected relationship with that of said imaging member.

6. An apparatus according to claim 5, wherein said controller includes a fixed frequency divider adapted to receive a signal from said voltage controlled oscillator and generates a measurement signal as a function thereof.

7. An electrophotographic printing machine of the type having a toner image developed on a on a photoconductive member moving at a first velocity with the fuser image developed therein being adapted to be transferred to a sheet, wherein the improvement includes:

a fusing member moving at a second velocity and being adapted to fuse the toner image to the sheet and advance the sheet at an adjustable velocity as the sheet receives the toner image from the photoconductive member, and a controller, in communication with the photoconductive member and said fusing member, to maintain the second velocity of said fusing member at a selected velocity less than the first velocity of said photoconductive member.

8. A printing machine according to claim 7, wherein said fusing member includes:

a rotatable fuser roll; and a pressure roll in contact with said fuser roll to define a nip through which the sheet passes for fusing the toner image to the sheet, said fuser roll and pressure roll being spaced from the photoconductive member a distance less than a distance between the sheet leading and trailing edges in the sheet direction of movement between the photoconductive member and said fuser roll.

9. A printing machine according to claim 8, further including:

first drive means for moving the photoconductive member at a first velocity; and second drive means for rotating said fuser roll to advance the sheet at a second velocity, said controller being in communication with said first drive means and said second drive means.

10. A printing machine of the type having a toner image developed on a moving photoconductive member adapted to be transferred to a sheet, wherein the improvement includes:

a fusing member including a rotatable fuser roll, and a pressure roll in contact with said fuser roll to define a nip through which the sheet passes for fusing the toner image to the sheet, said fuser roll and pressure roll being spaced from the photoconductive member a distance less than a distance between the sheet leading and trailing edges in the sheet direction of movement between said photoconductive member and said fuser roll;

first drive means for moving said imaging member at a first velocity including a crystal clock which generates a fixed reference signal, a programmable divider adapted to receive the fixed reference signal and generate a control signal as a function thereof, and a servo motor responsive to the control signal;

second drive means for rotating said fuser roll to advance the sheet at a second velocity; and a controller, in communication with the photoconductive member and said fusing member, to maintain the velocity of said fusing member at a selected relationship with that of said photoconductive member.

11. A printing machine of the type having a toner image developed on a moving photoconductive member adapted to be transferred to a sheet, wherein the improvement includes:

a fusing member including a rotatable fuser roll, and a pressure roll in contact with said fuser roll to define a nip through which the sheet passes for fusing the toner image to the sheet, said fuser roll and pressure roll being spaced from the photoconductive member a distance less than a distance between the sheet leading and trailing edges in the sheet direction of movement between said photoconductive member and said fuser roll;

first drive means for moving said imaging member at a first velocity;

second drive means for rotating said fuser roll to advance the sheet at a second velocity including a voltage controlled oscillator which generates a signal responsive to the velocity differential between said first drive means and said second drive means, a programmable divider adapted to receive the signal from said voltage controlled oscillator and generate a control signal based as a function thereof, and a servo motor responsive to the control signal; and a controller, in communication with the photoconductive member and said fusing member, to maintain the velocity of said fusing member at a selected relationship with that of said photoconductive member.

12. A printing machine according to claim 11, wherein said controller includes a fixed frequency divider adapted to receive a signal from said voltage controlled oscillator and generates a measurement signal function thereof.

* * * * *